United States Patent [19]

Segarra

[11] Patent Number: 4,715,590

[45] Date of Patent: Dec. 29, 1987

[54] POSITIONING DEVICE FOR THE INSTALLATION OF DOOR FRAMES, WINDOW FRAMES OR THE LIKE

[76] Inventor: Juan B. M. Segarra, Les Casetes 78, Masamagrell (Valencia), Spain

[21] Appl. No.: 884,242

[22] Filed: Jul. 10, 1986

[30] Foreign Application Priority Data

Nov. 25, 1985 [ES] Spain ..... 290.517

[51] Int. Cl.[4] ..... B25B 1/02

[52] U.S. Cl. ..... 269/76; 269/254 R; 269/904

[58] Field of Search ..... 269/904, 905, 254 R, 269/254 CS, 254 MW, 76

[56] References Cited

U.S. PATENT DOCUMENTS

| | | | |
|---|---|---|---|
| 2,599,010 | 6/1952 | Pernitz | 269/254 R |
| 2,806,495 | 9/1957 | Merkle et al. | 269/254 R |
| 3,018,098 | 1/1962 | Hunt | 269/254 CS |
| 3,632,101 | 1/1972 | Ross | 269/254 R |
| 3,753,556 | 8/1973 | Nix | 269/904 |

FOREIGN PATENT DOCUMENTS

| | | | |
|---|---|---|---|
| 152378 | 9/1955 | Sweden | 269/904 |

*Primary Examiner*—Robert C. Watson

*Attorney, Agent, or Firm*—Beveridge, DeGrandi & Weilacher

[57] ABSTRACT

An apparatus having an elongate, first member, positionable along a first axis, and a second member, carried on the elongate member so that both members are movable with respect to each other along that axis, is provided for fixedly pre-positioning frames for doors, windows or the like. The first axis is parallel to an axis of the frame. The second member has a first claw which extends outwardly along a second axis orthogonal to the first, a second claw, and means for fastening together the second member and the elongate member along the first axis. A cantilevered, biasing member is provided and is connected to one end of the elongate member such that when one of the claws of the second member is engaged over the corner of a frame, the biasing member causes the apparatus, and therefore the frame, to be held in the desired position.

14 Claims, 5 Drawing Figures

POSITIONING DEVICE FOR THE INSTALLATION OF DOOR FRAMES, WINDOW FRAMES OR THE LIKE

BACKGROUND OF THE INVENTION

The present invention pertains to an apparatus for supporting door frames, window frames or the like in a desired position until they are permanently fixed within a building.

The costs in terms of labor involved in carefully situating door frames, window frames or the like more than offset the expenses which would be incurred in correcting improperly placed frames. For example, an improperly constructed or situated door frame will later present problems for both opening and closing the door after it is installed in the frame. Further, just as occurs in windows, such a door frame would result in undesirable drafts. It is fundamental that good construction, necessarily being somewhat more expensive, even down to the details of door or window frames, makes life more pleasant for the future occupants. At the same time, it obviates corrective repairs in the future, which repairs often would have to be done by carpenters or other building experts.

An incorrectly positioned frame greatly hampers the carpenters' efforts in hinging a door to the frame so as to provide an appropriate swing for opening and/or closing the door.

Also during construction, it must be kept in mind that, the carpenters' efforts become more laborious and therefore more expensive when efforts are made to reduce the labor hours of brick layers, for example.

SUMMARY OF THE INVENTION

The apparatus for positioning door frames and window frames solves the aforementioned and other problems necessarily arising in the construction of habitable structures. More particularly, the present invention provides a device for fixedly positioning door and window frames until such frames are supported by, and fixed within the building itself. With these considerations in mind, the present invention provides apparatus which alone provides means for the situation of frames for doors, windows or the like during the incorporation of such frames into the building to avoid improper positioning of the frames within the structure. The apparatus further conserves labor, to reduce the costs thereof, by making it unnecessary for two workers to have to hold the frame in position until it could be permanently fixed within the building.

Thus, an apparatus for fixedly positioning door frames, window frames or the like in accordance with the present invention includes an elongate, first member positionable along a first axis parallel to an axis of the frame, and a moveable, second member which is carried upon the elongate member so that the two members are moveable with respect to each other along the first axis. The moveable member has a first claw extending outwardly therefrom along a second axis which is orthogonal to the first, and a second claw. Means are also provided on the moveable member for releasably fastening the elongate and moveable members together along the first axis. A cantilevered biasing member is connected to one end of the elongate member such that when one of the claws of the moveable member is engaged over a corner of the frame to be positioned, the biasing member biases the frame for the fixed positioning thereof.

BRIEF DESCRIPTION OF THE DRAWINGS

These and other aspects of the present invention are more apparent from the following detailed description and claims, particularly when considered in conjunction with the accompanying drawings in which like parts bear like reference numerals. In the drawings:

DETAILED DESCRIPTION OF THE PREFERRED EMBODIMENT OF THE INVENTION

Figure 1:
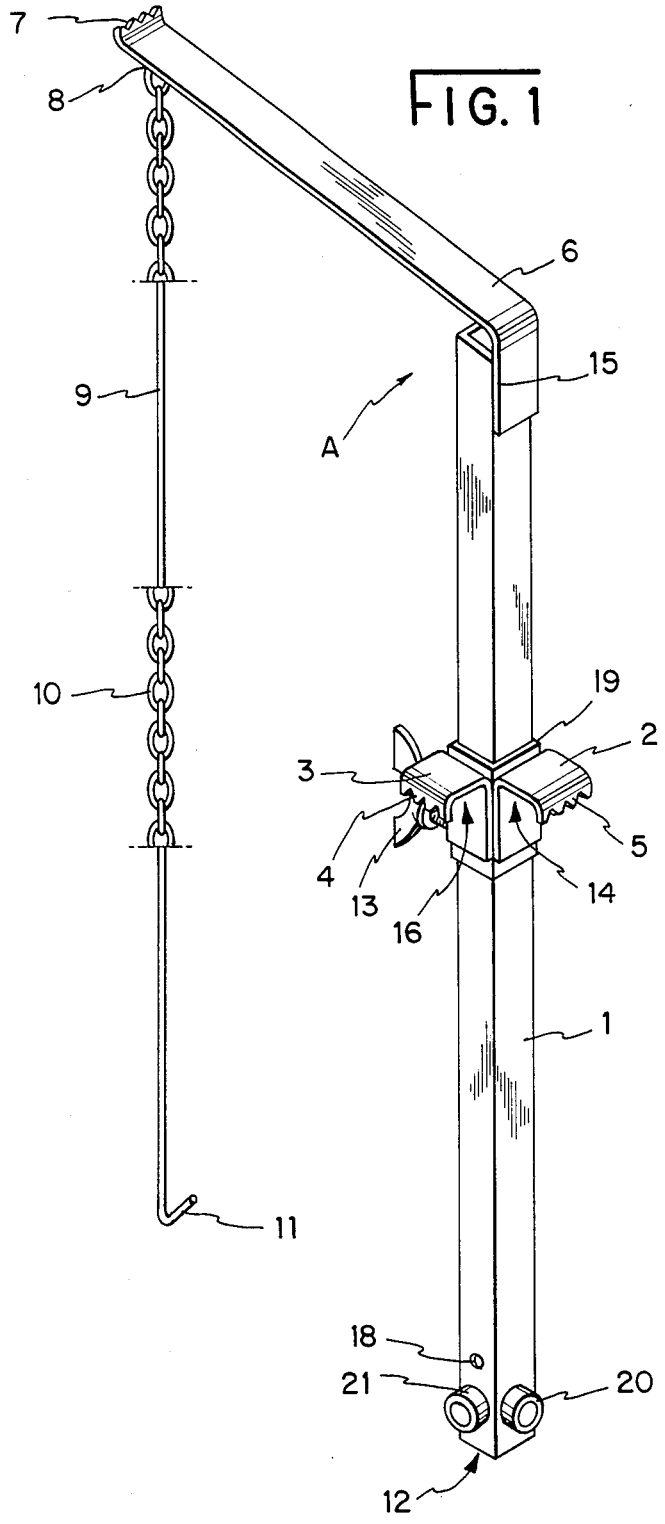
FIG. 1 is a perspective view of an apparatus for fixedly positioning frames in accordance with a preferred embodiment the present invention.

FIG. 1 is a perspective view of an apparatus A for fixedly pre-positioning a door frame, window frame or the like in accordance with the present invention. Apparatus A includes an elongate member 1. A moveable member 19 is carried by elongate member 1 so that members 1 and 19 are axially moveable with respect to each other. Moveable member 19 has a pair of claws 2 and 3. In FIG. 1, it is seen that elongate member 1 extends along a first axis while claws 2 and 3 extend in second and third axes which are mutually orthogonal and both orthogonal to the axis of member 1. Each of claws 2 and 3 terminates in bent over portions 5 and 4, respectively, having ridges for gripping the corner of a frame (not shown in FIG. 1).

Moveable member 19 further has a screw 13 to provide means for locking members 1 and 19 together. Alternatively, screw 13 could comprise a lever or any other element for fastening together members 1 and 19.

A cantilevered member 6 attaches at joint 15 to one end of the elongate element 1. Preferably, cantilevered member 6 is constructed from metal or a like material having high strength and resiliency when flexed downwardly. Cantilevered member 6 may be attached to member 1 by welding or otherwise as is apparent to those skilled in the art. At its free end, cantilevered member 6 terminates in an upwardly turned claw portion 7 likewise having ridges. Claw 7 thus is adapted for frictionally gripping the ceiling.

A fastener 8 connects restraining means 9 to the free end of cantilever 6. Restraining means 9 includes chain 10 at the remote end of which depends a hook 11. Alternatively, restraining means 9 could comprise a flexible metal cable or the like.

In the preferred embodiment, at least lower end 12 of elongate member 1 is tubular so that hook 11 can simply be hooked within lower end 12. In this way, cantilever 6 can be flexed and held in preparation for mounting apparatus A to a door or window frame.

Also mounted upon end 12, are a pair of stops 20 and 21. Stops 20 and 21 face outwardly from member 1 along the same axes as claws 2 and 3, respectively. Stop 20 extends outwardly for a distance such that when claw 2 is positioned over a frame, elongate member 1 would be suspended from the frame in a plane parallel to it. In the same way, stop 21 cooperates with claw 3. Preferably, stops 20 and 21 are fabricated from a rubber or plastic material which will provide good frictional contact with the frame to prevent end 12 from swinging outwardly when apparatus A is placed in engagement with the frame.

End 12 also has a hole 18 through one side thereof. The purpose of hole 18 will be discussed in the following.

In use, apparatus A is positioned over a frame (not shown in FIG. 1) whereupon claws 2 or 3 engage or grip the frame. In this way, apparatus A is supported by the frame and the apparatus actually hangs therefrom. So supported from the frame, elongate member 1 is positioned in a spaced-apart, parallel relationship with one of the vertical supports of the frame. Elongate member 1 is aligned with this axis since each of stops 20 and 21 extends outwardly from member 1 to engage the support. In this way, elongate member 1 can be checked, e.g. with a level (not shown) to determine whether the elongate member, and thus the frame, are level.

In order to fix the frame and apparatus A in place, hook 11 is made to engage end 12 of the elongate member 1. With hook 11 hooked to end 12, elongate member 1 is made to bear the force exerted by resilient cantilevered member 6, which force is transmitted through restraining means 9.

With hook 11 connected to end 12, screw 13 preferably is now loosened so that elongate member 1 may be moved upwardly until claw 7 contacts the ceiling (not shown in FIG. 1). Then, screw 13 is tightened to secure members 1 and 19 together, afterwhich hook 11 is disengaged from end 12. Due to its inherent resiliency, cantilevered member 6 will press clawed end 7 against the ceiling in gripping relationship therewith, To minimize movement of a frame positioned by apparatus A, it is preferable to arrange two apparatus A on the frame. Thus, a first apparatus A would be oriented on the frame so that its cantilevered member projects perpendicularly from the cross supports of the frame while a second apparatus A would be oriented so that its cantilevered member extends outwardly (and upwardly to grip the ceiling) in the same plane as defined by the frame. In the foregoing arrangement of two apparatus A, arranged with their respective cantilevered members projecting outwardly in perpendicular directions, all swinging or swaying movement of the frame would be prevented.

Most preferably, three apparatus A would be used in positioning a frame. To this end, two apparatus A would be arranged with their cantilevered members projecting forwardly of the frame and the third apparatus would be arranged to have its cantilevered member projecting within the plane defined by the frame. Alternatively, of course, the first two apparatus A could have their cantilevered members projecting rearwardly rather than forwardly.

Where claws 2 and 3 of moveable member 19 cannot reliably engage over a part of the frame, a bar (not shown) may be provided to enable engagement of apparatus A upon a central part of the frame, irrespective of whether stops 20 or 21 make contact with the frame. Such a bar (not shown) preferably would be metallic. It would engage elongate member 1 at hole 18.

Figure 3:
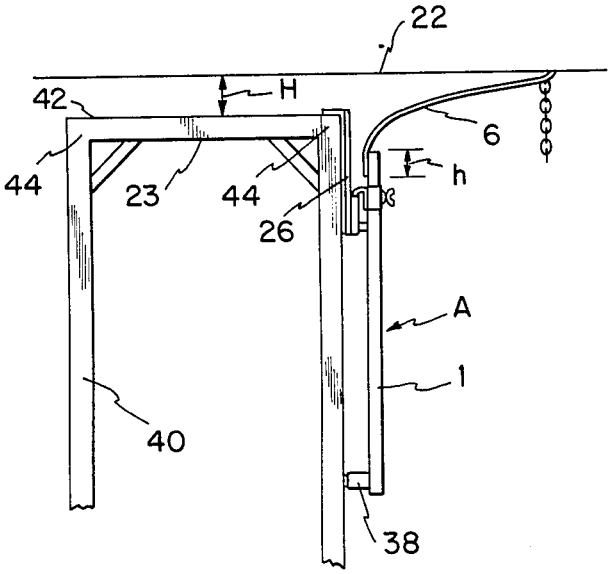
FIG. 3 is an elevated view of a wooden frame which is held stationary by the apparatus of FIGS. 1 and 2.

In FIG. 3, apparatus A is shown upon frame 23 together with hooked member 26. Exemplary frame 23 comprises a pair of vertical supports 40 connected by a cross-connecting element 42 to define a pair of upper corners 44. Where frame 23 is very nearly the height of the ceiling 22, and where moveable member 19 is prevented from disengaging elongate member 1 by the joint 15 between cantilevered member 6 and the elongate member, hooked member 26 is necessary to secure apparatus A to the frame. Accordingly, hooked member 26 is used in conjunction with apparatus A when the length, denoted by h, of joint 15 is greather than, or approximately equal to the distance H between the ceiling 22 and the top of the frame.

Figure 2:
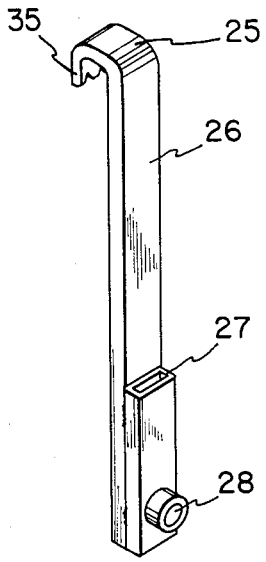
FIG. 2 is a perspective view of a hooked member usable with the apparatus of FIG. 1 in accordance with the present invention.

As seen from FIG. 2, hooked member 26 has a hooked end 25 having distal ridges 35. A tubular element 27 is mounted at the other end of hook member 26 and a stop 28 in turn is mounted to extend outwardly from element 27. An elongated stop 38 usable at end 12 of elongate member 1, ensures that member 1 will be correctly positioned upon the vertical support of the frame. Stop 28 abuts against member 1. Stop 28 likewise is preferably fabricated from a rubber or plastic material which provides good frictional contact with elongate member 1.

Figure 4:
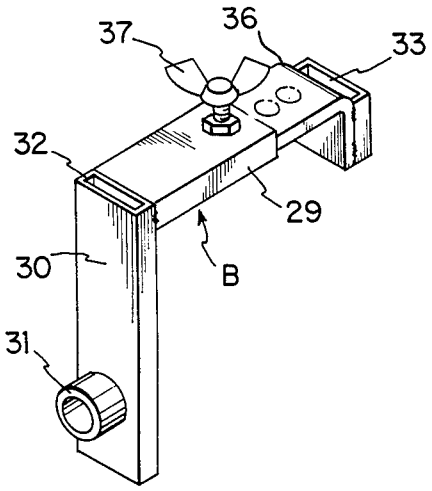
FIG. 4 is a perspective view of a U-shaped member likewise the apparatus of FIG. 1.

FIG. 4 shows a generally U-shaped member B having legs 30 and 33 connected by adjustable means 29, 36 and 37 together forming an adjustable web portion. U-shaped element B is particularly suitable for use with apparatus A in positioning aluminum or other metal frames rather than frames constructed from wood or the like. U-shaped member 8 omits claws which may not suitably anchor and instead slide over the surface of the metal. The spacing between legs 30 and 33 is variable. To this end, a female portion 29 receives a male portion 36 which is fastened with respect to female portion 29 by fastening means 37. At its distal end, leg 30 of a U-shaped member B also has a stop 31, preferably formed of plastic, rubber or the like as explained hereinbefore.

Figure 5:
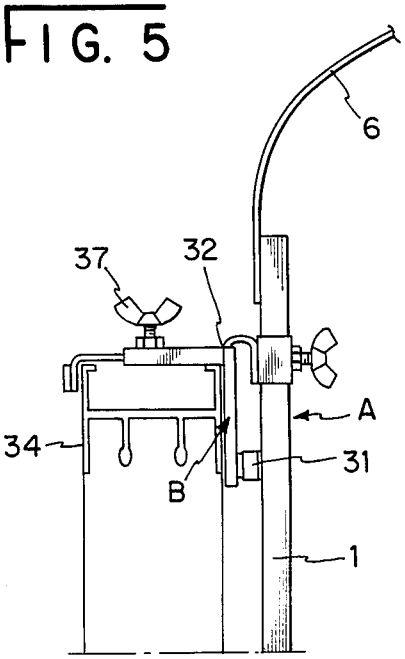
FIG. 5 is a side view of the apparatus of FIGS. 1 and 4 applied to a portion of a frame to be held stationary.

FIG. 5 demonstrates the use of U-shaped member B in conjunction with apparatus A. It is seen from FIG. 5, that U-shaped member B is adjusted to straddle the frame portion 34 whereby legs 30 and 33 extend downwardly along the sides of the frame portion. Tubular leg 30 receives one of claws 2 or 3 of apparatus A therein to connect apparatus A to the frame portion 34. Stop 31 of leg 30 ensures that elongate member 1 is spaced apart in parallel with the frame portion 34.

Apparatus A, and/or members 26 and B, are preferably made from an inexpensive material which is very light in weight. The material must provide adequate strength.

The present invention has been described with reference to a preferred embodiment which is merely exemplary. Numerous modifications, rearrangements and substitutions could be made to such embodiment, but the result would remain well within the scope of the invention.

I claim:

1. Apparatus for pre-positioning frames for doors, windows or the like with respect to a fixed surface remote from the frame to be positioned, said apparatus comprising:

an elongate, first member positionable along a first axis parallel to an axis of the frame;

a second member, carried on said first member, said first and second members being movable with respect to each other along said first axis, said second member having a first claw adapted to engage over the frame, siad first claw extending outwardly from said second member along a second axis orthogonal to said first axis, and means for releasably fastening said second member to said first member along said first axis; and cantilevered biasing means connected to one end of said first member with the free end of said cantilevered biasing means engageable with the fixed surface, whereby said biasing means is adapted to hold said apparatus and the frame in a predetermined position with respect to the fixed surface.

2. The appartus as claimed inclaim 1 wherein said second member further comprises a second claw, said second claw extending outwardly from said second member along a third axis orthogonal to said first and second axes.

3. The apparatus as claimed in claim 2 further comprising a hooked member having a hooked end and a straight end, and said coupling member receiving one of said claws of said second member, said hooked end being engagable with the frame.

4. The apparatus as claimed in claim 2 further comprising an U-shaped member having spaced apart legs and an adjustable connecting portion therebetween for straddling a portion of the frame, at least one of said legs being tubular, said tubular leg being adapted to receive one of said claws of said second member.

5. The apparatus as claimed in claim 3, wherein the free end of said biasing means has an upwardly turned claw and restraining means depending downwardly therefrom, said restraining means terminating in a hook engagable with said elongate, first member for pre-flexing said biasing means.

6. The apparatus as claimed in claim 4, wherein said biasing means has an upwardly turned claw at its free end and restraining means terminating in a hook engagable with said elongate, first member for pre-flexing said biasing member.

7. A kit for pre-positioning frames for doors, windows or the like, said kit comprising:

an assembly for immoveably supporting the frame until the frame is permanently fixed into the building, said assembly comprising, an elongate, first member, positionable along a first axis parallel to an axis of the frame, a second member, carried on said first member, said first and second members being moveable with respect to each other along said first axis, said second member having a first claw extending outwardly therefrom along a second axis orthogonal to said first axis, means for releasably fastening said second member to said first member along said first axis, and cantilevered biasing means connected to one end of said first member, whereby said first claw is engagable over the frame and said biasing means causes the frame to be held in a predetermined position; and first and second support means for supporting said assembly from the frame, said first and second support means being interchangeably connectable to said assembly, said first support means comprising a hooked member having a hooked end and a straight end, and a coupling member mounted on said straight end, said coupling member receiving said claw of said second member and said hooked end being engagable with the frame, and said second support comprising an U-shaped member having spaced-apart legs and an adjustable connecting portion therebetween for straddling a portion of the frame, at least one of said legs being tubular for receiving a claw of said second member.

8. A kit as claimed in claim 7 wherein said second member further comprises a second claw, said second claw extending outwardly from said second member along a third axis orthogonal to said first and second axes.

9. A kit as claimed in claim 8, wherein the free end of said biasing means has an upwardly turned claw and restraining means depending downwardly therefrom, said restraining means terminating in a hook engagable with said elongate, first member for pre-flexing said biasing means.

10. In combination with frames for doors, windows or the like to be positioned for incorporation into the construction of a building, an apparatus for prepositioning the frame comprising:

an elongate, first member positionable along a first axis parallel to an axis of the frame;

a moveable second member, carried on said first member, said first and second members being moveable with respect to each other along said first axis, said second member having a first claw extending outwardly therefrom along a second axis orthogonal to said first axis, a second claw extending outwardly from said second member along a third axis orthogonal to said first and second axes, and means for releasably fastening said second member to said first member along said first axis; and a cantilevered biasing means connected to one end of said first member, whereby either of said claws are engagable over the frame and said biasing means causes the frame to be held in a predetermined position.

11. The combination as claimed in claim 10 further comprising a hooked member having a hooked end and a straight end, and a coupling member mounted on said straight end, said coupling member receiving one of said claws of said second member, said hooked end being engagable with the frame.

12. The combination as claimed in claim 10 further comprising an U-shaped member having spaced apart legs and an adjustable connecting portion therebetween for straddling a portion of the frame, at least one of said legs being tubular, said tubular leg being adapted to receive one of said claws of said second member.

13. The combination as claimed in claim 11, wherein the free end of said biasing means has an upwardly turned claw and restraining means depending downwardly therefrom, said restraining means terminating in a hook engagable with said elongate, first member for pre-flexing said biasing means.

14. The combination as claimed in claim 12, wherein said biasing means has an upwardly turned claw at its free end and restraining means terminating in a hook engagable with said elongate, first member for pre-fixing said biasing means.

* * * * *